US010599100B2

(12) United States Patent
Lenoir

(10) Patent No.: US 10,599,100 B2
(45) Date of Patent: Mar. 24, 2020

(54) MULTI-BLADE SHOCK ABSORBER

(71) Applicant: Montres Breguet S.A., L'Abbaye (CH)

(72) Inventor: Deirdre Lenoir, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/675,830

(22) Filed: Aug. 14, 2017

(65) Prior Publication Data

US 2018/0059619 A1 Mar. 1, 2018

(30) Foreign Application Priority Data

Aug. 30, 2016 (EP) ..... 16186316

(51) Int. Cl.

| | |
|---|---|
| ***G04B 31/02*** | (2006.01) |
| ***G04B 31/04*** | (2006.01) |
| *G04B 31/004* | (2006.01) |
| *G04B 43/00* | (2006.01) |

(52) U.S. Cl.

CPC ..... *G04B 31/04* (2013.01); *G04B 31/004* (2013.01); *G04B 43/002* (2013.01)

(58) Field of Classification Search

CPC .... G04B 31/04; G04B 31/004; G04B 43/002; G04B 31/00; G04B 31/008; G04B 31/0082

See application file for complete search history.

(56) References Cited

U.S. PATENT DOCUMENTS 1,976,181 A 10/1934 Marti
2,538,142 A * 1/1951 Zurcher ..... G04B 31/04 368/326
2,543,328 A * 2/1951 Morf ..... G04B 31/04 368/326
2,750,731 A * 6/1956 Colomb ..... G04B 31/0082 368/324
2,919,961 A * 1/1960 Matthey ..... G04B 31/02 384/225
3,036,871 A * 5/1962 Matthey ..... G03C 1/49 368/326
4,468,134 A * 8/1984 Halicho ..... G04B 39/00 368/308
8,926,170 B2 * 1/2015 Helfer ..... G04B 31/02 368/287
9,632,483 B2 * 4/2017 Boulenguiez ..... G04B 17/26
(Continued)

FOREIGN PATENT DOCUMENTS

| | | |
|---|---|---|
| CH | 335173 | 12/1958 |
| EP | 2 796 940 A2 | 10/2014 |
| FR | 1.186.621 | 8/1959 |

OTHER PUBLICATIONS

European Search Report dated Jun. 9, 2017 in European Application 16186316.2, filed on Aug. 30, 2016 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

The present invention relates to a shock-absorbing device for a staff of a wheel set of a timepiece arranged on a support, wherein said support is provided with an at least partially through slot for a pivot element cooperating with a pivot shank of the staff of the wheel set to be inserted therein, wherein said device additionally comprises a spring means comprising at least a first blade and a second blade.

17 Claims, 4 Drawing Sheets

(56) References Cited

U.S. PATENT DOCUMENTS

| | | | | |
|---|---|---|---|---|
| 2006/0215499 | A1* | 9/2006 | Kohler | G04B 31/04<br>368/324 |
| 2013/0188462 | A1* | 7/2013 | Helfer | G04B 31/04<br>368/326 |

* cited by examiner

MULTI-BLADE SHOCK ABSORBER

This application claims priority from European patent application No. 16186316.2 filed on Aug. 30, 2016, the entire disclosure of which is hereby incorporated herein by reference.

The present invention relates to a shock-absorbing device for a staff of a wheel set of a timepiece arranged on a support, wherein said support is provided with an at least partially through slot for a pivot element cooperating with a pivot shank of the staff of the wheel set to be inserted therein, wherein said device additionally comprises a spring means comprising at least a first blade and a second blade.

TECHNOLOGICAL BACKGROUND

There exist shock-absorbing or anti-shock systems in timepieces for protecting the staffs of the wheel sets. A first system is a lyre-type system, i.e. the plate or bridge is provided with a hole, through which the pivot shank of a staff can pass. This hole serves as receptacle for a support that is pierced at its centre, in which a setting is arranged. This setting carries a pierced stone and an endstone, wherein the whole unit is placed under stress by a lyre spring arranged between the support, which has edges serving as support points, and the setting. Another system is the "parechute" system, in which the pivots of the balance are configured in order to give them the form of a cone and hold them in place by means of a small turning pin of corresponding shape mounted on a spring blade.

Watchmaking anti-shock systems are generally formed by mechanical springs and are also dimensioned in the traditional manner following practical rules regarded as the best compromise between mechanical stability during operation and resistance to mechanical deformations.

In particular, anti-shock elements of the balance spring, i.e. para-chute and lyre type elements, are dimensioned so as not to be activated until relatively significant shock accelerations (between 200 and 500 times gravity) because of the prestressing of the spring. Beyond this threshold value the spring can be deformed and absorb a portion of the energy of the shock. However, because of the poor mechanical absorption of the metal blades used as anti-shock elements most of the energy is returned to the balance. Local deformation of the pivot of the balance is therefore highly probable, even in the case of relatively light shocks. This deformation, which has a considerable impact on the chronometric precision of the watch, is generally ignored because the standard certifying the chronometric stability of a watch COSC following a shock of one metre is not very severe (60 s/d).

There is therefore a need to improve the chronometric stability of the watch after a shock.

SUMMARY OF THE INVENTION

The aim of the invention is to remedy the disadvantages of the prior art by proposing to provide a shock-absorbing device.

For this purpose, the present invention relates to a shock-absorbing device for a staff of a wheel set of a timepiece arranged on a support, wherein said support is provided with an at least partially through slot for a pivot element cooperating with a pivot shank of the staff of the wheel set to be inserted therein, wherein said device additionally comprises a spring means comprising at least a first blade and a second blade spaced from one another extending from the support, and wherein the first blade is in contact with said pivot element and exerts a prestress.

In a first advantageous embodiment said blades extend in parallel.

In a second advantageous embodiment said blades extend in the same direction.

In a third advantageous embodiment said blades extend in a convergent direction, wherein the point of intersection of the blades is located facing the pivot element.

In a fourth advantageous embodiment said pivot element consists of a free pivot stone axially in its slot, wherein this pivot stone comprises a recess, in which the pivot shank of the shaft is inserted.

In a fifth advantageous embodiment said pivot element consists of a free setting axially in said slot, wherein a pierced stone and an endstone are driven into said setting.

In a sixth advantageous embodiment said pivot element and the first blade only form one single piece.

In a seventh advantageous embodiment said pivot element is a pivot stone driven into a hole arranged on the first blade.

In another advantageous embodiment said first blade and the second blade have different rigidities, wherein the first blade is less rigid than the second blade.

In another advantageous embodiment the spring means additionally comprise a third blade, wherein the third blade is more rigid than the second blade.

In another advantageous embodiment the difference in rigidity between the different blades is achieved by differentiating the material between the blades and/or by having elastic blades of different dimensions/shapes.

In another advantageous embodiment the elastic blades are fixed to the support by means of a stud fitted with washers arranged between two elastic blades to allow them to be spaced.

In another advantageous embodiment the stud is attached to the support.

In another advantageous embodiment the stud is formed in a single piece with the support.

In another advantageous embodiment said slot is a completely through slot and has an inside edge, from which the elastic blades extend.

BRIEF DESCRIPTION OF THE FIGURES

The aims, advantages and features of the invention will become clearer from the following detailed description of at least one embodiment of the invention given solely as a non-restrictive example and illustrated by the attached drawings, wherein.

DETAILED DESCRIPTION

The general idea of the present invention is to provide a shock-absorbing system that is progressive in the absorption of shocks.

Figure 1:
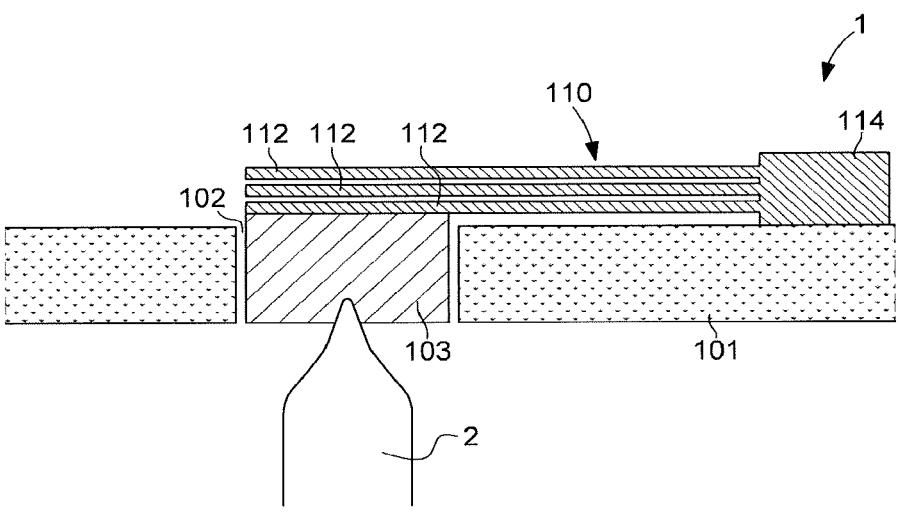
FIGS. 1 and 11 show diagrams of a first device embodiment according to the invention.

FIG. 1 shows a shock-absorbing device 1 or anti-shock system according to a first embodiment. This shock-absorbing device or anti-shock system 1 is mounted in a base element 101 or support of a timepiece movement. In particular, the plate or the bridges of the movement are the base element, in which the anti-shock system 1 according to the invention is positioned. This shock-absorbing device is used to absorb the shocks of a staff 2 of a timepiece wheel set: a wheel train or a balance or an escape wheel.

This base element or support 101 is provided with an opening 102 facing the staff 2 to be damped. The staff 2 cooperates with a pivot element 103. This pivot element 103 can be a pivot stone having a recess so that the pivot shank of the shaft is inserted there. This pivot stone could be freely positioned directly in the opening or via a setting so that it can be displaced at least axially during a shock.

The shock-absorbing device additionally comprises one of the spring means 110 to damp the staff of the wheel set.

Figure 2:
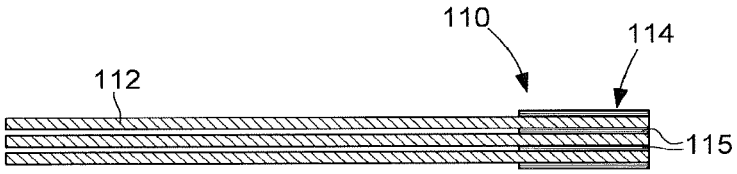
FIGS. 2 and 3 are schematic views of different practical examples of the spring means according to the invention.
Figure 8:
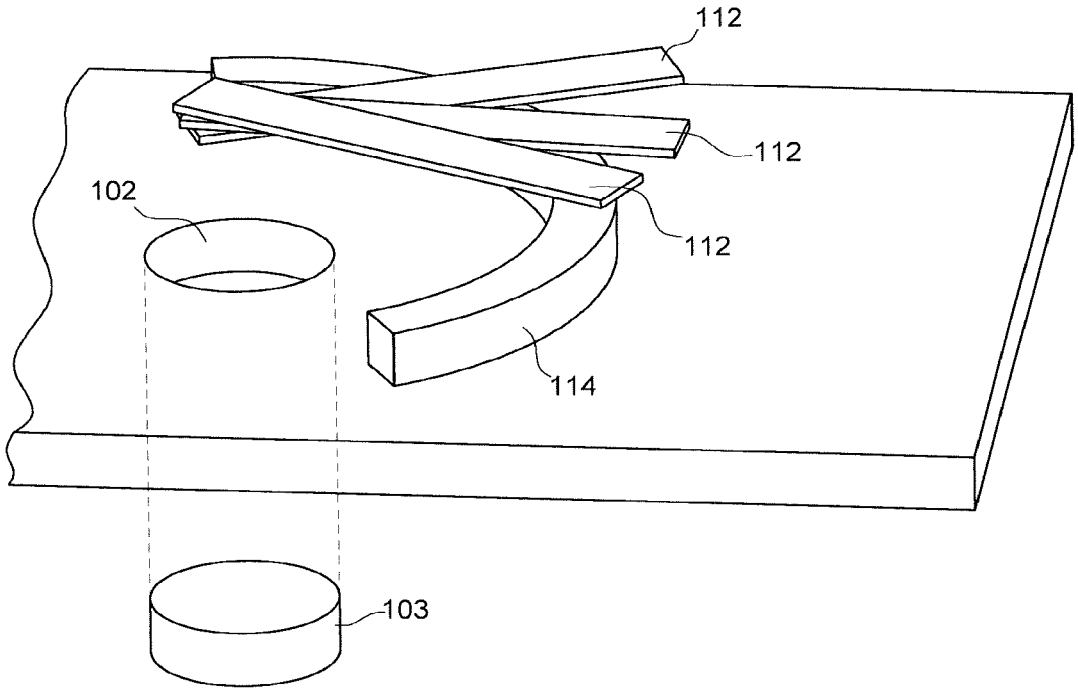
FIGS. 8 to 10 shows variants of the invention.
Figure 9:
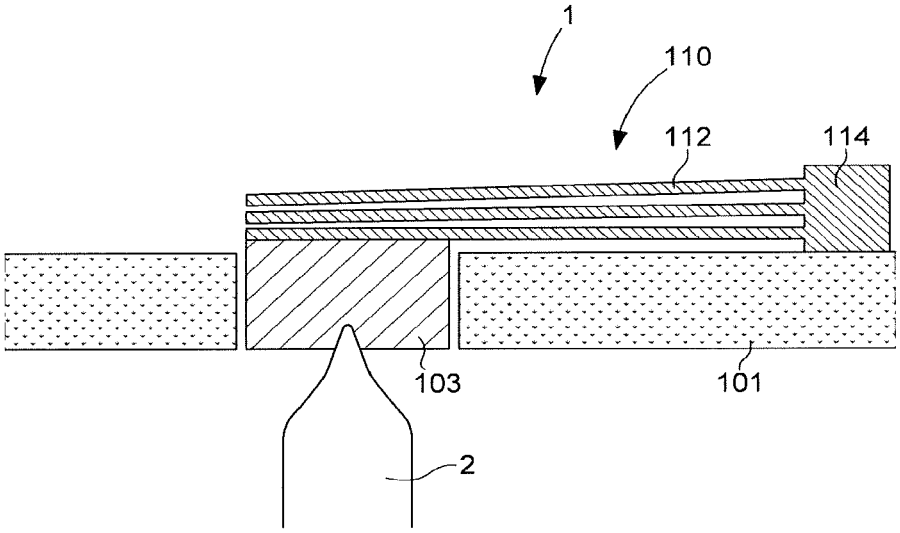
Figure 10:
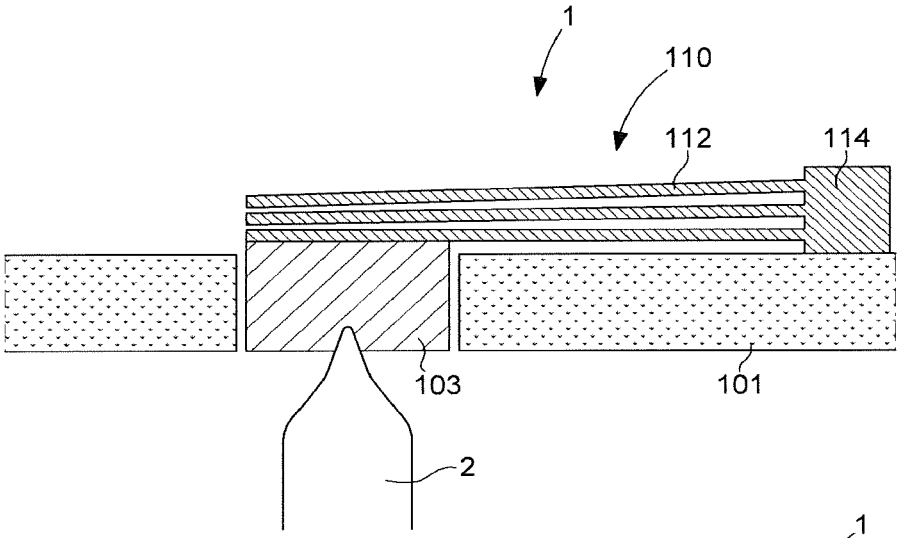

These spring means, evident in FIG. 2, advantageously have a plurality of elastic blades 112. These blades are arranged to be superposed on top of one another. In this first embodiment the elastic blades extend from a stud 114. This stud 114 is a part, which can be secured by screwing, gluing, welding or soldering to the plate or to the balance bridge. The elastic blades therefore extend from one of their ends fixed to the stud. The blades 112 are spaced from one another via washers 115 so that they can be deformed independently of one another and have an inter-blade spacing (preferably adjustable). This inter-blade space can be constant or larger or smaller than the space at the level of the stud at the level of the free end of the blades, as evident in FIGS. 9 and 10. These blades can extend in the same direction or not. In the case where the blades extend in different directions the attachment points of the different blades are spaced so as to have blades that converge, the intersection points of the different blades ideally being located facing the pivot stone, as evident in FIG. 8.

The assembly 110 formed by the elastic blades 112 and the stud 114 is thus arranged so that one of the elastic blades, in particular the elastic blade facing the pivot element, exerts a prestress. It is understood from this that the elastic blade is in contact with the pivot element and exerts a pressure on it. This configuration with several blades allows a progressive anti-shock rigidity enabling a greater quantity of energy (of the shock) to dissipate through multiple 'impacts' and by using highly dissipative materials.

In a first embodiment evident in FIGS. 1 and 2 the blades forming the spring means 110 are identical in their dimensions and materials. The operation of this assembly is as follows. In the event of a shock, the apparent rigidity felt by the balance (or any other timepiece wheel set) increases progressively by identical discrete steps as a function of the deflection (thus as a function of the energy of the shock).

The discontinuous rigidity occurs when one of the blades 112 is deflected sufficiently to come into abutment against the following blade: at this moment the energy of the shock (kinetic energy of the balance) is partially dissipated by an impact mechanism (characterised by a certain coefficient of restitution). Therefore, the discontinuous rigidity allows the dissipation of energy to increase during the shock.

Figure 3:
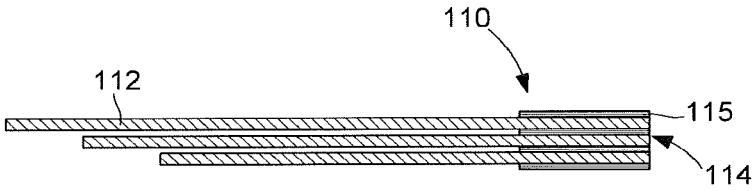

In a second embodiment evident in FIG. 3 the blades 112 differ in their materials and dimensions. In fact, the dissipative effect and the rigidity profile can be optimised by using blades of different geometries or materials.

The use of different materials can allow the introduction of highly dissipative materials (such as certain copper or aluminium variants) together with perfectly elastic materials (that exhibit no dissipation at all) such as silicon, silicon carbide, silicon nitride or metallic glasses.

In this case the elastic blade or blades 112 allow perfect positioning after the shock, whereas blades 112 made of dissipative materials allow a reduction of the energy of the shock experienced by the pivot of the balance. This dual behaviour is impossible to obtain with a single blade, because generally highly dissipative materials are very easily subject to plastic deformations. Advantageously, the main blade 112 that rests directly on the pivot stone must have dimensions ranging between the following limits:

Length: 10 mm-20 mm

Width: 0.2 mm-2 mm

Thickness: 0.05 mm-0.5 mm

The other blades 112 can be adjusted outside these limits in accordance with the materials used, the weight of the balance and other geometric parameters of the movement.

In the case of a change in dimension the aim to be achieved is the same, i.e. to modify the rigidity of the blades 112 in order to obtain an adequate response to a shock.

Preferably, the first elastic blade 112, i.e. the blade 112 in contact with the pivot element 103, is designed to be sufficiently elastic to plasticise sufficiently late, and the other blades 112 are more rigid to allow a better dissipation of the energy of the shock.

In a second embodiment the elastic blades 112 are arranged to replace the pivot element 103. This is understood to mean that the elastic blades 112 and the pivot element 103 form a single unit.

For this, these elastic blades 112 are arranged so that the first blade, i.e. the blade closest to the base element (plate or bridge), serves as pivot element 103. There are two possible solutions for this.

Figure 4:
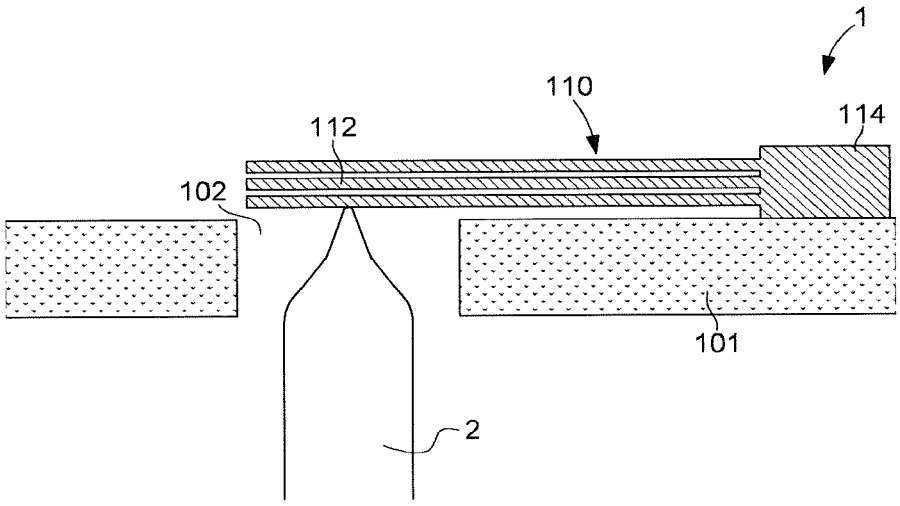
FIGS. 4 to 6 show diagrams of a second device embodiment according to the invention and one of its variants.

The first solution evident in FIG. 4 consists of using the first blade 112 directly as pivot element. This is understood to mean that the elastic blade 112 is made from a first material and that the pivot shank of the staff comes into contact with this first material. The elastic blade 112 could be provided with a recess that facilitates placement of the pivot shank of the staff.

Figure 5:
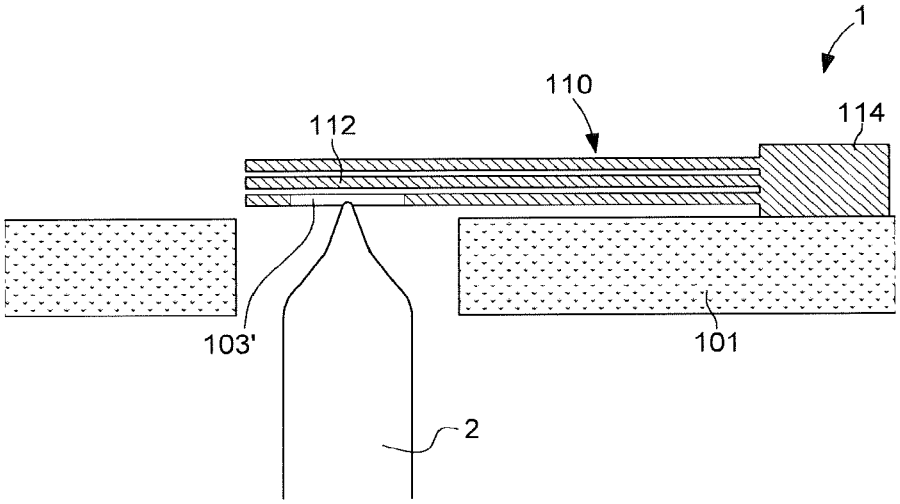

In a second solution evident from FIG. 5 the first elastic blade 112 bears a pivot element 103'. For this, the elastic blade 113 has a hole, either a through hole or not, in which a pivot element is arranged. This pivot element will preferably be a pivot stone of a ruby-type material. This pivot stone will be secured by gluing, welding, soldering or using any other conceivable fastening methods.

This second solution advantageously allows protection against any possible problems of incompatibility. In fact, the use of a stone made from ruby guarantees a restriction of the vibrations at the level of the pivot shank or the staff and therefore better efficiency.

Figure 6:
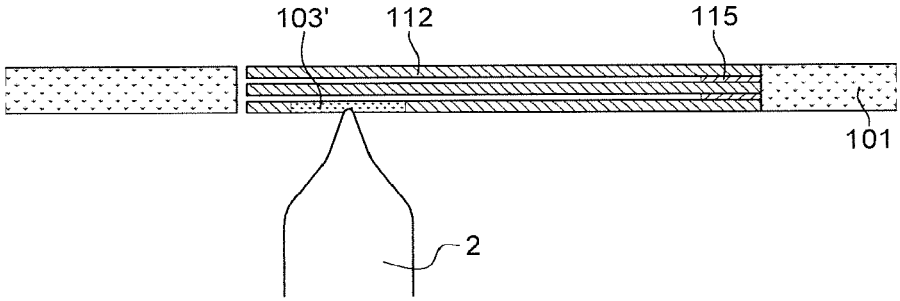

In a variant of this second embodiment evident in FIG. 6 the elastic blades 112 extend inside the opening of the base element 101, i.e. the plate or bridge. In this case, the opening 102 has an inside edge or wall, from which the elastic blades 112 extend.

This variant advantageously allows a greater compactness by integrating the blades 112 directly in the opening 102, which limits the thickness of the system.

Figure 7:
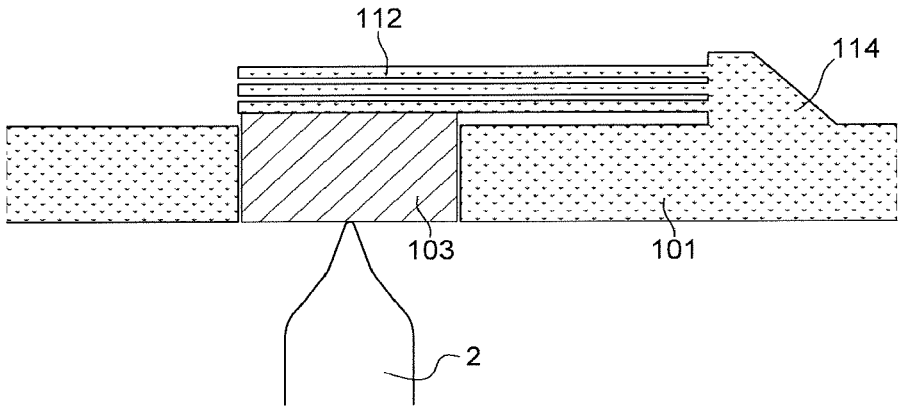
FIG. 7 shows a variant of the different embodiments.

In a variant of these two embodiments evident in FIG. 7 the elastic blades 112 forming the spring means 110 are formed in a single piece with the support element 101. There are several possibilities offered for this. The first consists of using metallic glasses known for their forming properties when they are heated between their glass transition temperature Tg and their crystallisation temperature Tx.

Another solution consists of making the assembly formed by the spring means and the base element from silicon using a LIGA or DRIE method.

It will be understood that various modifications and/or improvements evident to a person skilled in the art can be applied to the different embodiments of the invention described in the present description without departing from the framework of the invention.

In fact, it is possible to conceive an overall increase in absorption by adding a viscoelastic material or a viscous fluid between two or more blades.

Figure 11:
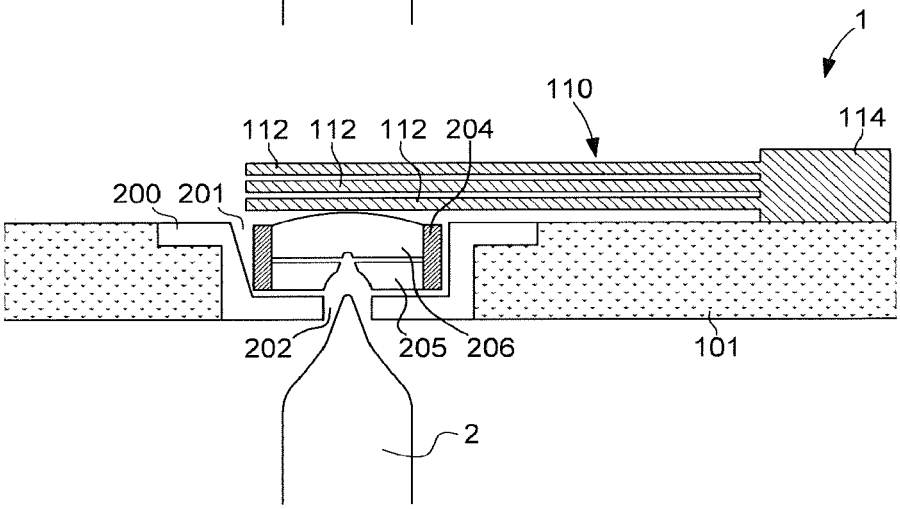

Moreover, it is also possible that the opening 102 of the base element serves to drive therein a block support 200 provided with a slot 201 and a through hole 202 in order to accommodate the pivot element 103 therein, which will be located at the base of the slot of the block support of the opening. The pivot element, which will be a simple stone or a setting 204 with a pierced stone 205 and an endstone 205 will rest in the base of the block support, as evident in FIG. 11.

The invention claimed is:

1. A shock-absorbing device for a timepiece, comprising:

a support including a block support, the block support including an at least partially through slot and a through hole;

a staff of a wheel set of the timepiece arranged on the support;

a pivot stone including a free setting, a pierced stone, and an endstone, the pivot stone being arranged in the slot and placed on a base of the block support, the pierced stone and the endstone having a same width and being driven into the free setting; a pivot shank of the staff of the wheel set to pass through the through hole and the pierced stone, and be inserted in the endstone; and a plurality of blades including at least a first blade and a second blade spaced from one another extending from the support, wherein the first blade is in contact with the endstone and exerts a prestress wherein an upper surface of the endstone in contact with the first blade has a convex shape, and the apex of the convex upper surface contacts the first blade.

2. The device according to claim 1, wherein said plurality of blades extend in parallel.

3. The device according to claim 1, wherein said plurality of blades extend in the same direction.

4. The device according to claim 1, wherein said plurality of blades extend in a convergent direction, wherein a point of intersection of the plurality of blades is located facing the pivot stone.

5. The device according to claim 1, wherein the endstone includes a recess, in which the pivot shank of the shaft is inserted.

6. The device according to claim 1, wherein said pivot stone and the first blade form one single piece.

7. The device according to claim 1, wherein said pivot stone is driven into a hole arranged on the first blade.

8. The device according to claim 1, wherein the plurality of blades further include a third blade, wherein the third blade is more rigid than the second blade.

9. The device according to claim 8, wherein the difference in rigidity between the first blade and the second blade is achieved by at least one of differentiating a material between the first blade and the second blade and having elastic blades of different at least one of dimensions and shapes.

10. The device according to claim 8, wherein the first blade and the second blade are elastic blades of different dimensions or shapes.

11. The device according to claim 1, wherein the plurality of blades are fixed to the support by a stud fitted with washers arranged between two of the plurality of blades to allow them to be spaced, said plurality of blades are elastic.

12. The device according to claim 11, wherein the stud is attached to the support.

13. The device according to claim 11, wherein the stud is formed in a single piece with the support.

14. The device according to claim 13, wherein said slot is a completely through slot and has an inside edge, from which the plurality of blades extend, said plurality of blades are elastic.

15. A shock-absorbing device for a timepiece, comprising:

a support including an at least partially through slot;

a staff of a wheel set of the timepiece arranged on the support;

a pivot stone cooperating with a pivot shank of the staff of the wheel set to be inserted therein, said pivot stone being arranged in the slot; and a plurality of blades including at least a first blade and a second blade spaced from one another extending from the support, wherein the first blade is in contact with the pivotstone and exerts a prestress, wherein the first blade and the second blade having different rigidities, the first blade being less rigid than the second blade, and wherein an upper surface of the pivotstone in contact with the first blade has a convex shape, and the apex of the convex upper surface contacts the first blade.

16. The device according to claim 15, wherein a difference in rigidity between the first blade and the second blade is achieved by at least one of differentiating a material between the first blade and the second blade and having elastic blades of different at least one of dimensions and shapes.

17. The device according to claim 15, wherein the first blade and the second blade are elastic blades of different dimensions or shapes.

* * * * *